US008241397B2

(12) United States Patent
Gu et al.

(10) Patent No.: US 8,241,397 B2
(45) Date of Patent: Aug. 14, 2012

(54) ADSORPTIVE GAS SAMPLER USING IONIC NANO-DROPLETS

(75) Inventors: Alex Gu, Plymouth, MN (US); Adam Dewey McBrady, Minneapolis, MN (US); Wei Yang, Minnetonka, MN (US)

(73) Assignee: Honeywell International Inc., Morristown, NJ (US)

( * ) Notice: Subject to any disclaimer, the term of this patent is extended or adjusted under 35 U.S.C. 154(b) by 544 days.

(21) Appl. No.: 12/407,679

(22) Filed: Mar. 19, 2009

(65) Prior Publication Data

US 2009/0235817 A1 Sep. 24, 2009

Related U.S. Application Data

(60) Provisional application No. 61/037,999, filed on Mar. 19, 2008.

(51) Int. Cl.
*B03C 3/014* (2006.01)

(52) U.S. Cl. ..... 95/71; 95/3; 96/19; 96/27; 96/53; 96/68

(58) Field of Classification Search ..... 95/2, 3, 95/71, 72; 96/18, 19, 27, 52, 53, 63, 68, 96/69, 74, 98; 239/3, 690
See application file for complete search history.

(56) References Cited

U.S. PATENT DOCUMENTS

| | | | | |
|---|---|---|---|---|
| 3,802,625 | A * | 4/1974 | Buser et al. | 239/704 |
| 4,095,962 | A | 6/1978 | Richards | |
| 4,141,698 | A * | 2/1979 | Kihlstedt et al. | 95/69 |
| 4,761,164 | A * | 8/1988 | Pez et al. | 95/44 |
| 5,855,649 | A * | 1/1999 | Durham et al. | 95/71 |
| 5,914,454 | A * | 6/1999 | Imbaro et al. | 95/64 |
| 6,656,253 | B2 * | 12/2003 | Willey et al. | 96/27 |
| 7,531,027 | B2 * | 5/2009 | Tepper et al. | 96/27 |
| 7,717,980 | B2 * | 5/2010 | Tepper et al. | 95/71 |
| 7,780,761 | B2 * | 8/2010 | Gu et al. | 95/66 |
| 7,883,034 | B2 * | 2/2011 | Matsui et al. | 239/695 |
| 7,959,717 | B2 * | 6/2011 | Yano et al. | 96/27 |
| 2003/0131727 | A1 * | 7/2003 | Fissan et al. | 95/58 |
| 2004/0023411 | A1 | 2/2004 | Fenn | |
| 2006/0185511 | A1 * | 8/2006 | Tepper | 95/71 |
| 2008/0063558 | A1 * | 3/2008 | Coleman | 422/4 |
| 2008/0121106 | A1 * | 5/2008 | Tepper et al. | 96/27 |
| 2009/0114090 | A1 * | 5/2009 | Gu et al. | 95/66 |

OTHER PUBLICATIONS

Aki, S. N. V. K., et al., "High-Pressure Phase Behavior of Carbon Dioxide with Imidazolium-Based Ionic Liquids", *The Journal of Physical Chemistry B*, 108(52), (2004), 20355-20365.

Anthony, J. L., et al., "Anion Effectts on Gase Solubility in Ionic Liquids", *The Journal of Physical Chemistry B*, 109(13), (2005), 6366-6374.

(Continued)

*Primary Examiner* — Richard L Chiesa
(74) *Attorney, Agent, or Firm* — Schwegman, Lundberg & Woessner P.A.

(57) ABSTRACT

An air scrubber, system, and method of use are provided. The air scrubber includes an electrospray nozzle for creating an ionic fluid electrospray plume; an air sample intake positioned to provide an air sample interacting with the ionic fluid electrospray plume; and a counter electrode positioned to collect the electrospray plume. The selected chemicals in the air sample are captured by ionic fluid electrospray plume and accumulate on the counter electrode.

13 Claims, 3 Drawing Sheets

OTHER PUBLICATIONS

Anthony, J. L., et al., "Solubilities and Thermodynamic Properties of Gases in the Ionic Liquid 1-*n*-Butyl-3-methylimidazolium Hexafluorophosphate", *The Journal of Physical Chemistry B*, 106(29), (2002), 7315-7320.

Bates, E. D., et al., "$CO_2$ Capture by a Task-Specific Ionic Liquid", *Journal of the American Chemical Society*, 124(6), (2002), 926-927.

Blanchard, L. A, et al., "Recovery of Organic Products from Ionic Liquids Using Supercritical Carbon Dioxide", *Industrial & Engineering Chemistry Research*, 40(1), (2001), 287-292; (Correction, Industrial & Engineering Chemistry Research, 40(11) at p. 2550 (2001).

Blanchard, L. A, et al., "Green Processing Using Ionic Liquids and $CO_2$", *Nature*, vol. 399, (1999), 28-29.

Brennecke, J. F., et al., "Ionic Liquids: Innovative Fluids for Chemical Processing", *AIChE Journal*, 47(11), (2001), 2384-2389.

Crosthwaite, J. M., et al., "Liquid phase behavior of imidazolium-based ionic liquids with alcohols: effect of hydrogen bonding and non-polar interactions", *Fluid Phase Equilibria*, 228-229, (2005), 303-309.

Crosthwaite, J. M., et al., "Liquid Phase Behavior of Ionic Liquids with Alcohols: Experimental Studies and Modeling", *The Journal of Physical Chemistry B*, 110(18), (2006), 9354-9361.

Crosthwaite, J. M., et al., "Phase Transition and Decomposition Temperatures, Heat Capacities and Viscosities of Pyridinium Ionic Liquids", *The Journal of Chemical Thermodynamics*, 37(6), (Abstract Only), (2005), 1 pg.

Fredlake, C. P., et al., "Thermophysical Properties of Imidazolium-Based Ionic Liquids", *Journal of Chemical & Engineering Data*, 49(4), (2004), 954-964.

Heintz, A., et al., "Thermodynamic Properties of Mixtures Containing Ionic Liquids. 2. Activity Coefficients at Infinite Dilution of Hydrocarbons and Polar Solutes in 1-Methyl-3-ethyl-imidazolium Bis(trifluoromethyl-sulfonyl) Amide and in 1,2-Dimethyl-3-ethyl-imidazolium Bis(trifluoromethyl-sulfonyl) Amide Using Gas-Liquid Chromatography", *Journal of Chemical & Engineering Data*, 47(4), (2002), 894-899.

Rodriguez, H., et al., "Temperature and Composition Dependence of the Density and Viscosity of Binary Mixtures of Water + Ionic Liquid", *Journal of Chemical & Engineering Data*, 51(6), (2006), 2145-2155.

Tepper, G., et al., "A New Air Sampler based on Electrically Charged Liquid Nanodroplets", *Sixth IEEE Conference on Nanotechnology* (*IEEE-NANO 2006*), (2006), 781-782.

Wasserscheid, P ,, et al., "Ionic Liquids—New "Solutions" for Transition Metal Catalysis", *Angew. Chem. Int. Ed.*, vol. 39, (2000), 3772-3789.

Welton, T., "Room-Temperature Ionic Liquids. Solvents for Synthesis and Catalysis", *Chemical Reviews*, 99(8), (1999), 2071-2083.

* cited by examiner

ADSORPTIVE GAS SAMPLER USING IONIC NANO-DROPLETS

RELATED APPLICATIONS

This application claims the benefit of priority, under 35 U.S.C. Section 119(e), to U.S. Provisional Patent Application No. 61/037,999, filed on Mar. 19, 2008, which is incorporated herein by reference.

BACKGROUND

Air quality is important for many environments. In these environments, current technologies direct contaminated air through a series of air filters and scrubbers. The filters remove particulates, while the air scrubber removes the toxic/hazardous gaseous contaminants. The air scrubber is typically a large, heavy, high power consuming device, which has a low scrubbing efficiency over a narrow contaminant spectrum and a limited lifetime.

An ideal scrubber should have a high scrubbing efficiency over a wide scrubbing spectrum, a long lifetime, a low power consumption, and a small size and/or light weight. Current scrubbing technologies do not meet these critiria. For example, Venturi scrubbers, spray towers, and tray towers are extremely high power consuming devices that consume about 5 to about 8 kilowatt (kW)/1000 cubic feet per minute (cfm). Further, the floating bed and packed columns scrubbers have high pressure drops and high liquid-to-gas ratios (50 gallons (gal)/1000 cfm).

BRIEF DESCRIPTION OF THE DRAWINGS

Embodiments of the invention may be best understood by referring to the following description and accompanying drawings, which illustrate such embodiments. In the drawings.

DETAILED DESCRIPTION OF THE INVENTION

Figure 1:
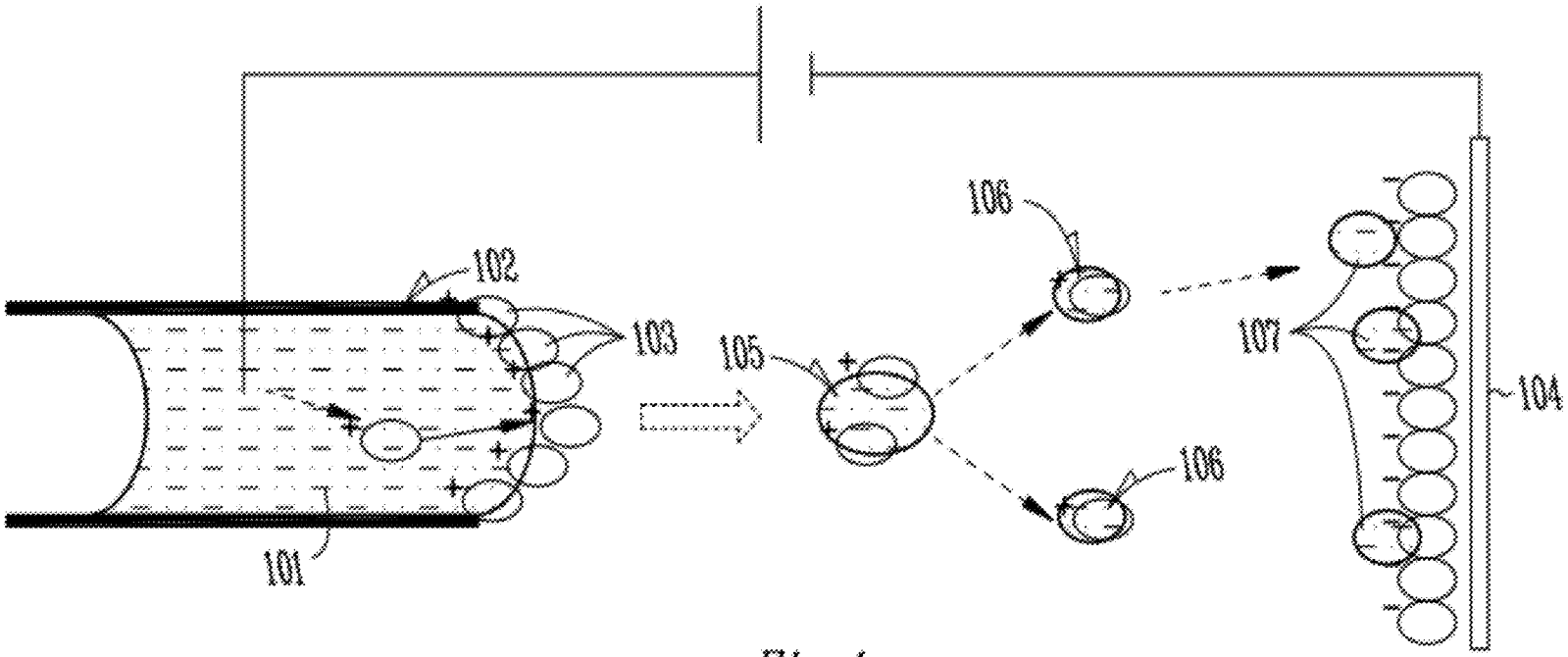
FIG. 1 is a schematic representation of the general principles of electrospray technology.

The present invention provides an ionic liquid electrospray air scrubber (ILEAS) for air cleaning applications. The ionic liquid electrospray air scrubber uses charged ionic liquid (IL) nano-droplets formed through an electrospray process to capture a wide variety of air contaminants. The ionic liquid electrospray air scrubber combines the superb solubility characteristics of ionic liquids with the high charge density and high surface area of electrospray nano-droplet plumes. The advantages of the ionic liquid electrospray air scrubber include: (1) a wide spectrum of solubility by ionic liquids or ionic liquid mixtures that allows capturing of organic air contaminants; (2) greater than 90% capturing efficiency of contaminants from the air in real time while using minimal amounts of ionic liquid; (3) a greater than 100× power efficiency in a lighter and smaller scrubber; (4) the ability to recycle the ionic liquid or ionic liquid mixtures; and (5) the ability to easily custom-tailor systems for applications with air flow rates from liters to thousands of liters/min.

The ionic liquid electrospray air scrubber (ILEAS) combines the ideal dissolution properties of ionic liquids with electrospray's ability to create a highly charged, high surface area solvating mist. The ionic liquid electrospray air scrubber affords a high contaminant capturing efficiency, a wide contaminant capturing spectrum, a low power consumption, and a small footprint. Further, the contaminated ionic liquid may be recycled via electrochemical redox and/or thermal desorption of the captured contaminants, to enable a long continuous system operational lifetime.

The present invention provides an air scrubber including: an electrospray nozzle for creating an ionic fluid electrospray plume; an air sample intake positioned to provide an air sample flowing through the ionic fluid electrospray plume; and a counter electrode positioned to collect the electrospray plume such that selected chemicals in the air sample are captured by ionic fluid electrospray plume and accumulate on the counter electrode.

In one embodiment, the air scrubber further includes a first reservoir for holding ionic fluid coupled to the electrospray nozzle. In another embodiment, the counter electrode includes a porous metal frit.

In one embodiment, the air scrubber further includes a second reservoir for holding contaminated ionic fluid, wherein the contaminated ionic fluid includes chemicals originally in the air sample that have been captured by the ionic fluid. In another embodiment, the second reservoir further includes an apparatus for oxidizing, reducing, or oxidizing and reducing the contaminated ionic fluid. In yet another embodiment, the oxidizing, reducing, or oxidizing and reducing the contaminated ionic fluid provides a reusable ionic fluid.

In one embodiment, the air scrubber canister further includes a pump for causing air samples to flow through air scrubber or to augment an air flow already present in the air scrubber.

The present invention also provides an air scrubber system. The air scrubbing system includes an air scrubber including: an electrospray nozzle for creating an ionic fluid electrospray plume; an air sample intake positioned to provide an air sample flowing through the ionic fluid electrospray plume; a counter electrode positioned to collect the electrospray plume such that selected chemicals in the air sample are captured by ionic fluid electrospray plume and accumulate on the counter electrode as dissolved chemical within the collected ionic fluid; and an electrical source for applying an alternating electrical potentials/voltages between the electrospray nozzle and the counter electrode.

In one embodiment, the air scrubber system further includes a detector positioned to analyze the air sample flowing through the counter electrode. In another embodiment, the detector is a mass spectrometer. In yet another embodiment, a wall of the air scrubber and the counter electrode are grounded.

In one embodiment, the air scrubber system further includes a pump for causing air samples to flow through air scrubbing system or to augment an air flow already present in the air scrubbing system.

The present invention further provides a method of scrubbing air for chemicals. The method includes: exposing an air sample to an ionic fluid electrospray plume; applying an alternating electrical potential between an electrospray nozzle and a counter electrode; and collecting the ionic fluid electrospray plume on an electrospray counter electrode.

DEFINITIONS

The words and phrases presented in this patent application have their ordinary meanings to one of skill in the art unless otherwise indicated. Such ordinary meanings may be obtained by reference to their use in the art and by reference to general and scientific dictionaries, for example, *Webster's New World Dictionary*, Simon & Schuster, New York, N.Y., 1995, *The American Heritage Dictionary of the English Language*, Houghton Mifflin, Boston Mass., 1981, and *Hawley's Condensed Chemical Dictionary,* 14$^{th}$ edition, Wiley Europe, 2002.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise. Thus, for example, a reference to "a formulation" includes a plurality of such formulations, so that a formulation of compound X includes formulations of compound X.

Ionic Liquids

Room temperature ionic liquids (RTIL) are specially designed organic salts that are liquids at room temperature. Examples of typical ionic liquids include:

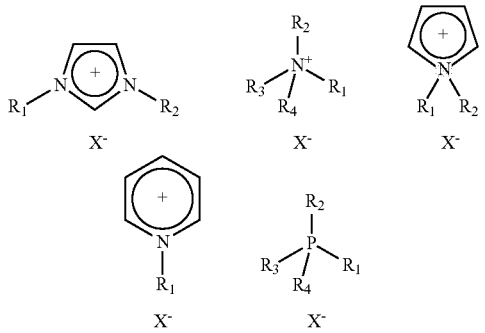

X = Cl, $NO_3$, $CH_3CO_2$, $CF_3CO_2$, $BF_4$, $CF_3SO_3$, $PF_6$, $(CF_3SO_2)_2)N$

The extremely low vapor pressures throughout a wide temperature range and wide array of solvating properties make ionic liquids an ideal industrial solvent replacement for volatile organic compounds (VOCs). In addition, most ionic liquids are electrochemically inert between −4 and +4 volts. This inertness and their low electrical resistance allows for recycling of the ionic liquids by electrochemically reducing or oxidizing the captured gaseous contaminants.

The ionic fluids are composed of a cation and an anion, whose forces of attraction are not sufficiently strong to hold them together as a solid at ambient temperature. These salts are therefore, liquids. RTILs are organic fluids that contain nitrogen-based organic cations and inorganic anions. RTILs generally comprise imidazolium or pyridinium cations having alkyl groups in the $C_2$ to $C_8$ range. Anions are generally small inorganic species such as $[BF_4]^-$, $[PF_6]^-$, triflate $[TfO]CF_3SO_2^-$, nonaflate $[NfO]CF_3(CF_2)_3SO_2^-$, bistrifluoromethane sulfonimide $[Tf_2N]$ $(CF_3SO_2)_2N^-$, trifluoroacetate $[TA]CF_3CO_2^-$, heptafluorobutanoate $[HB]CF_3$ $(CF_2)_3$ $CO_2^-$ or $[NO_3]^-$. This property allows them to dissolve organic compounds and serve as potential solvents for industrially important organic reactions. Ionic liquids are environmentally friendly because they have no detectable vapor pressure and they are also non-flammable. Suitable RTILs include, for example, trimethylphenylammonium bistrifluoride, 1,3-butylmethylpyrrolidinium bistriflamide, 1,3-butylmethylimidazolium bistriflamide, 1,3-ethylmethylimidazolium bistriflamide, 1,3-ethylmethylpyrrolidinium bistriflamide, 1,3-trihexyltetradecanephosphonium bistriflate, butylmethylimidazolium hexafluorophosphate, butylmethylimidazolium tetrafluoroborate, ethylmethylimidazolium bis(trifluoromethanesulfonyl)amide, ethylmethylimidazolium trifluoromethanesulfone, ethylmethylimidazolium dicyanamide, 1-butyl-3-methylimidazolium chloride, 1-butylpyridinum chloride, or the like, or a combination thereof.

In designing ionic liquid mixtures for air scrubbing, there are a number of different types of intermolecular interactions that may be used. For example, each interaction may be viewed as one absorption site in a typical solid absorbent, which greatly reduces the mass of ionic liquid needed for contaminant capturing. With ionic liquids, each cation, anion, and anion-cation pair may participate in a number of interactions at once. The possible interactions include: electrostatic, dipole/dipole, dipole/induced dipole, London π dispersion, π stacking, and hydrogen bonding. The affinity of any contaminant for an ionic liquid depends on the competition between contaminant/anion and contaminant/cation interactions with anion/cation interactions of ionic liquid itself. For example, for polar contaminants such as dimethyl methylphosphonate and benzophenone, electrostatic and dipole/dipole interactions typically play roles in dissolution into the ionic liquid. For non-polar contaminants like benzene or cyclohexane, dipole/induced dipole forces and London dispersion forces typically are the primary means of solubilization. Hydrogen bonding between an ionic liquid and chemical solute typically increases the solubility of the contaminant.

Contaminants with a proton donating/accepting nature such as acids and alcohols form hydrogen bond with ionic liquids. Ionic liquids are also very good solvents for non-polar aromatic analytes, like benzene, due to π-π interactions between the ionic liquids and the contaminant.

The subtle interplay of analytes/ionic liquid interactions with intra-ionic liquid cation/anion interactions offers custom-tailoring of the ionic liquid solvating characteristics. This interplay may be effectively achieved by changing the cation and/or anion substituting functional groups. For example, a temperature of 335° K is required to make 1-butyl-3-methyl pyridinium bis(trifluoromethylsulfonyl)imide (i.e., $[Bmpy][Tf_2N]$) fully miscible with 1-hexanol. Substituting the butyl chain of $[Bmpy][Tf_2N]$ with a hexyl chain drops the miscible temperature to 310° K. This tailoring capability allows the selection of an ionic liquid or ionic liquid mixture that is fully capable of scrubbing a wide spectrum of contaminants from the air.

Typical contaminants that may be used to evaluate the efficiency and breadth of ionic liquid electrospray air scrubber's contaminants capturing ability include, for example, dimethyl methylphosphonate, benzophenone, cyclohexanol, thiophene, cyclohexane, benzene, and carbon disulfide. Their dipole moments and refractive indices are shown in Table 1.

TABLE 1

| Contaminant | Dipole Moment | Refractive Index ($\times 10^{-30}$ C · m, n) |
|---|---|---|
| Dimethyl methylphosphonate | 12.1 | 1.413 |
| Benzophenone | 9.0 | 1.589 |
| Cyclohexanol | 6.0 | 1.464 |
| Thiophene | 1.3 | 1.529 |
| Cyclohexane | 0 | 1.426 |

TABLE 1-continued

| Contaminant | Dipole Moment | Refractive Index ($\times 10^{-30}$ C · m, n) |
|---|---|---|
| Benzene | 0 | 1.501 |
| Carbon disulfide | 0 | 1.628 |

This selection of contaminants covers a large range of the polarity. Furthermore, the three non-polar contaminants, cyclohexane, benzene, and carbon disulfide, have greatly different polarizabilities.

With regard to the above contaminants, a set of ionic liquids for capturing them may be selected. Table 2 shows four possible ionic liquid candidates and the solubility of four representative solvents (PM=partly miscible, M=miscible, I=immiscible). For example, 1-butyl-3-methyl imidazolium tetrafluoroborate (i.e., [$C_4$MIM][$BF_4$]) offers solubilization of high polarity contaminants such as tetrahydrofuran (THF). [$C_4$MIM] bis(trifluoromethylsulfonyl) imide (i.e., [$C_4$MIM][$TF_2$N]) has a larger hydrophobic anion than [$C_4$MIM][$BF_4$]. As such, it covers the lower polarity chemicals such as dichloromethane ($CH_2Cl_2$). With the same anion, [$TF_2$N], [$C_6$MIM] and [$C_8$MIM] differ only in their alkyl chain lengths. The impact this structural change has on the capturing efficiency of the ionic liquid may be extrapolated to select additional ionic liquids.

TABLE 2

Ionic Liquids for Chemical Capturing

| Ionic liquids | | Solvents | | | |
|---|---|---|---|---|---|
| Cations | Anions | $H_2O$ (% w/w) | MeOH | THF | $CH_2Cl_2$ |
| [$C_4$MIM] | $BF_4$ | M | M | M | I |
| [$C_4$MIM] | [$TF_2$N] | 1.17% | PM | M | M |
| [$C_6$MIM] | [$TF_2$N] | 0.88% | PM | M | M |
| [$C_8$MIM] | [$TF_2$N] | 0.74% | PM | M | M |

Although ionic liquids offer multiple interaction mechanisms for contaminant capturing, the interactions are low energy. The strongest interaction, hydrogen bonding, is roughly 20 kJ/mol or about 25 times lower than any intramolecular bond. Other contaminant ionic liquid interactions enthalpies will be typically less than 5 kJ/mol.

As such, ionic liquids and their mixtures represent an essentially endless, yet predictable, solvating media for simultaneous dissolution and subsequent desorption of a wide variety of contaminants.

Electrospray

Electrospray is generated by applying a high voltage (several kV/cm) between a conductive liquid and a counter electrode. Referring to FIG. 1, a schematic representation of the general principles of electrospray technology is shown. When the conductive liquid 101 is housed in a small (100's of μm) electrospray nozzle 102, the intense electrical field accumulates a very high number of charges on the liquid meniscus 103 formed at the nozzle tip (i.e., the Taylor cone). The electrostatic attraction between this high charge density meniscus 103 and the counter electrode 104 exerts a strong force on the meniscus 103. When this force overrides the surface tension of the liquid 101, highly charged droplets 105 break off from the meniscus 103. The droplets 105 high net charge may result in its hydrodynamic instability, causing the primary droplet 105 to break up into many secondary smaller droplets 106 via Coulomb repulsion. This process results in high surface area (up to approximately 1,000 $m^2/g$) spray plume. These highly charged droplets 106 may travel toward and ultimately discharge at the counter electrode 107. This is manifested by the less than μA current flowing between the spray nozzle 102 and the counter electrode 104 at approximately kV applied voltage. From these numbers, one may estimate the typical power consumption of ionic liquid electrospray air scrubber is at approximately W/1000 cfm range, which is typically 3-orders of magnitude lower than conventional technologies (approximately kW/1000 cfm).

As all of the droplets are of the same charge, similar repulsion forces are responsible for the mist expanding in a hyperbolic cone. Although electrode localized oxidative/reductive reactions have been observed after hours of DC spraying, they may be effectively prevented by using an AC source. The ionic liquid electrospray air scrubber uses AC bias to drive the electrospray. As the switching of bias polarity is transient, recombination of the positively and negatively charged droplets generated during each polarity phase have little effect on the capturing efficiency of the ionic liquid electrospray air scrubber system. The highly charged, high surface area electrospray plumes are useful for air scrubbing. Table 3 illustrates the capturing efficiency of water electrospray plumes for acidic gases; elementary compounds; pharmaceuticals; explosives; and a chemical warfare agent simulant. The capturing efficiency was defined as:

$$\text{Capturing Efficiency (\%)} = \frac{[\text{Before Scrubbing}] - [\text{After Scrubbing}]}{[\text{Before Scrubbing}]} \times 100\%$$

TABLE 3

Capture Efficiency of Traditional Solvent Electrospray Scrubbers

| Chemical Captured | Concentration | Solvent Sprayed | Capturing Efficiency (%) | Reference |
|---|---|---|---|---|
| Sulfur | 50 ppm | Water | Greater than 99% | C. N. Richards (U.S. Pat. No. 4,095,962) |
| $NO_2$ | 10 ppm | Water/ $NH_4OH$ | Greater than 90% | C. N. Richards (U.S. Pat. No. 4,095,962) |
| $SO_2$ | 170 ppm | Water/ $NH_4OH$ | Greater than 90% | C. N. Richards (U.S. Pat. No. 4,095,962) |
| TNT | 30 ppt | Water/ MeOH | Greater than 98% | J. B. Fenn (U.S. Patent Application Publication No. 2004/0023411A1) |
| RDX | 30 ppt | Water/ MeOH | Greater than 98% | J. B. Fenn (U.S. Patent Application Publication No. 2004/0023411A1) |
| HMX | 30 ppt | Water/ MeOH | Greater than 98% | J. B. Fenn (U.S. Patent Application Publication No. 2004/0023411A1) |
| Caffeine | 10 ppt | Water/ MeOH | Greater than 96% | J. B. Fenn (U.S. Patent Application Publication No. 2004/0023411A1) |
| Cocaine | 10 ppt | Water/ MeOH | Greater than 96% | J. B. Fenn (U.S. Patent Application |

TABLE 3-continued

Capture Efficiency of Traditional Solvent Electrospray Scrubbers

| Chemical Captured | Concentration | Solvent Sprayed | Capturing Efficiency (%) | Reference |
|---|---|---|---|---|
| Methyl Salicylate | Less than 142 ppm | Water/ EtOH | Greater than 90% | Publication No. 2004/0023411A1) Tepper et al., IEEE-NANO 2006, Sixth IEEE Conference on Nanotechnology, Volume: 2, 2006, 781-782 |

Typically the capturing efficiencies are greater than 90% and the capturing efficiency does not drop for higher contaminant concentration. This definition of capturing efficiency does not provide for the mass flow rate of the contaminants.

Although the fundamental physics of the electrospray-analyte capturing process are yet to be understood, empirical models do exist. Richards (U.S. Pat. No. 4095962) developed such an empirical model to describe the capturing efficiency data obtained from a water-based electrospray scrubber prototype.

TABLE 4

Effective Radius of an Approximately 50-nm Droplet Carrying 0.5 × Rayleigh Limit Charge, Typically Seen in an Electrospray

| | |
|---|---|
| C (Coulumb Constant) | 9.00E+09 |
| K (J/K) | 1.38E−23 |
| T (K) | 300 |
| # Charge/Droplet | 6.20E+03 |
| Q (Coulomb) | 9.92E−16 |
| Dipole Moment (C.m.) | 6.20E−30 |
| $R_o$ (nm) | 143 |

In this model, the capturing efficiency is calculated as $\Gamma=1-e^{-\Omega}$. Where $\Omega$ is the sweeping ratio, defined as the sweeping volume of the droplets divided by the total air volume scrubbed. The sweeping volume of the droplets is calculated as: $V_s=N\times\pi r_0^2\times v_{gd}$, where $V_s$ is the nano-droplet sweeping volume in L/s, N is the number density of nano-droplets per second, $v_{gd}$ is the relative velocity between the air stream and the nano-droplets and $r_0$ is the droplet effective radius which may be calculated as $$r_0=\sqrt{\frac{4CQ\vec{p}}{3kT}}.$$

C is the Coulomb constant; Q is the number of charge on the nano-droplet; k is Boltzman constant; and $\vec{p}$ is the dipole moment of the analyte molecule (average value approximately $6.2\times10^{-30}$ C.m). Table 4 illustrates the effective radius for an approximately 50 nm radius droplet carrying 0.5× Rayleigh limit net charge (typically seen in electrospray). The effective radius is approximately 134 nm, 2.5× larger than the actual radius of the droplet. This dramatic increase of effective radius significantly improves the contaminant capturing efficiency. Table 5 illustrates the predicted contaminant capturing efficiency of a ionic liquid electrospray air scrubber where ionic liquids are sprayed at 2 μl/min and the air flows at 13.5 L/min flow rate.

TABLE 5

Predicted Contaminant Capturing Efficiency of a Hypothetical Scrubber Scenario

| | |
|---|---|
| Ionic Liquid Spray Rate (μl/min) | 2.00 |
| Droplet Radius (nm) | 43.8 |
| No. of Droplets (1/sec) | 9.4E+10 |
| Air Flow Rate (L/min) | 13.5 |
| Ionic Liquid Mass Spray Rate (mg.min) | 2.772 |
| Analyte Mass Flow Rate (mg/min) | 0.0604 |
| Mass Flow Rate Ratio | 45.93 |
| Sweeping Ratio | 4.19 |
| Contaminant Capturing Efficiency | 98.5% |

According to above empirical equations, the sweeping ratio is approximately 4 causing a predicted capturing efficiency of approximately 98.5%. As indirect evidence to the above first principle-based calculation, Richards (U.S. Pat. No. 4,095,962) reported a approximately 100× fold increase in $SO_2$ capture efficiency by electrospray compared to the equilibrium concentrations of $SO_2$ over a water/ammonia solution. Table 5 also illustrates that the ionic liquid mass spray rate is approximately 46× higher than the mass flow rate of a 1 ppm concentration analyte. This high mass flow rate ratio helps ensure abundant capturing capacity and preservation of the captured analytes in the spent ionic liquid.

Electrospray Ionic Liquid

Although electrospray water plumes offer excellent capturing efficiencies for a few contaminants, they are typically insufficient for general purpose air scrubbing. First, water, a highly polar solvent, is not effective at dissolving hydrophobic contaminants, for example, non-polar and large polar ones. Second, water quickly evaporates, creating high humidity and off-gassing problems for a re-usable air scrubbing apparatus. In contrast, ionic liquids do not exhibit either of these negative traits. However, the relatively high viscosity of non-polar and large polar liquids may pose mass transfer limitations. Electrospray ionic liquids typically eliminate this mass transfer limitation. Table 6 illustrates the enhanced mass transfer kinetics of the electrosprayed ionic liquid droplet.

TABLE 6

Estimated Capturing Kinetics for an Approximately 50-nm Droplet Electrospray Plume

| | |
|---|---|
| Ionic Liquid Spray Rate (μl/min) | 2.00 |
| Droplet Radius (nm) | 43.8 |
| No. of Droplets (1/sec) | 9.4E+10 |
| Air Flow Velocity (cm/sec) | 1.79E+01 |
| Droplet Mean Resident Time (sec) | 5.57E−01 |
| Diffusion Time (Gas to Droplet Surface (sec)) | 2.80E−06 |
| Diffusion Time Dissolution (sec) | 1.25E−06 |
| Total Capturing Time Needed (sec) | 4.05E−06 |

The available interaction time between the contaminants and the droplet is approximately 557 ms (mean resident time of the charged droplet before it reaches the counter electrode), while the total characteristic time needed for contaminant capturing is on the order of approximately 4 μs. This time includes, for example, contaminant diffusion from the flow stream to the droplet surface and dissolving into the droplet. This short time may be the result of the large number of droplets in the flow stream reducing the effective diffusion length of the contaminant molecules and the nano-scale droplet size allowing fast dissolution of the contaminants into the droplet in spite of the low diffusion constant within the ionic liquid, approximately $10^{-7}$ $cm^2$/sec.

The system may experience contaminant level, humidity, and temperature problems. The mass transfer kinetics are typically not affected dramatically by the contaminant level under the saturation limit of the ionic liquid, which may be determined by the mass flow ratio between ionic liquid and the contaminant. Since the contaminant molecules are neutral, as soon as the contaminant is captured and dissolved into the ionic liquid droplet, the droplet has a refreshed charge surface for further capturing. The effects of humidity may be two fold. Increasing humidity typically decreases the viscosity and facilitates the dissolution kinetics but may also reduce the capturing spectrum. Typically, up to 2% (w/w) of water does not affect the dissolution characteristics of the ionic liquids. As may be seen from Table 2, the selected $[C_n MIM][TF_2N]$ ionic liquids all have very low water uptake (less than 1.5% w/w). At humidity levels above those percentages, the surplus water vapor may pass through the system. Reduced temperatures may increase the ionic liquid viscosity and may slow down the contaminant dissolution process. As such, ionic liquid electrospray typically creates a high surface area, a high charge density, and a broad solubility spectrum ionic liquid nano-droplet plume, which enables high efficiency broad spectrum contaminant scrubbing.

Figure 2:
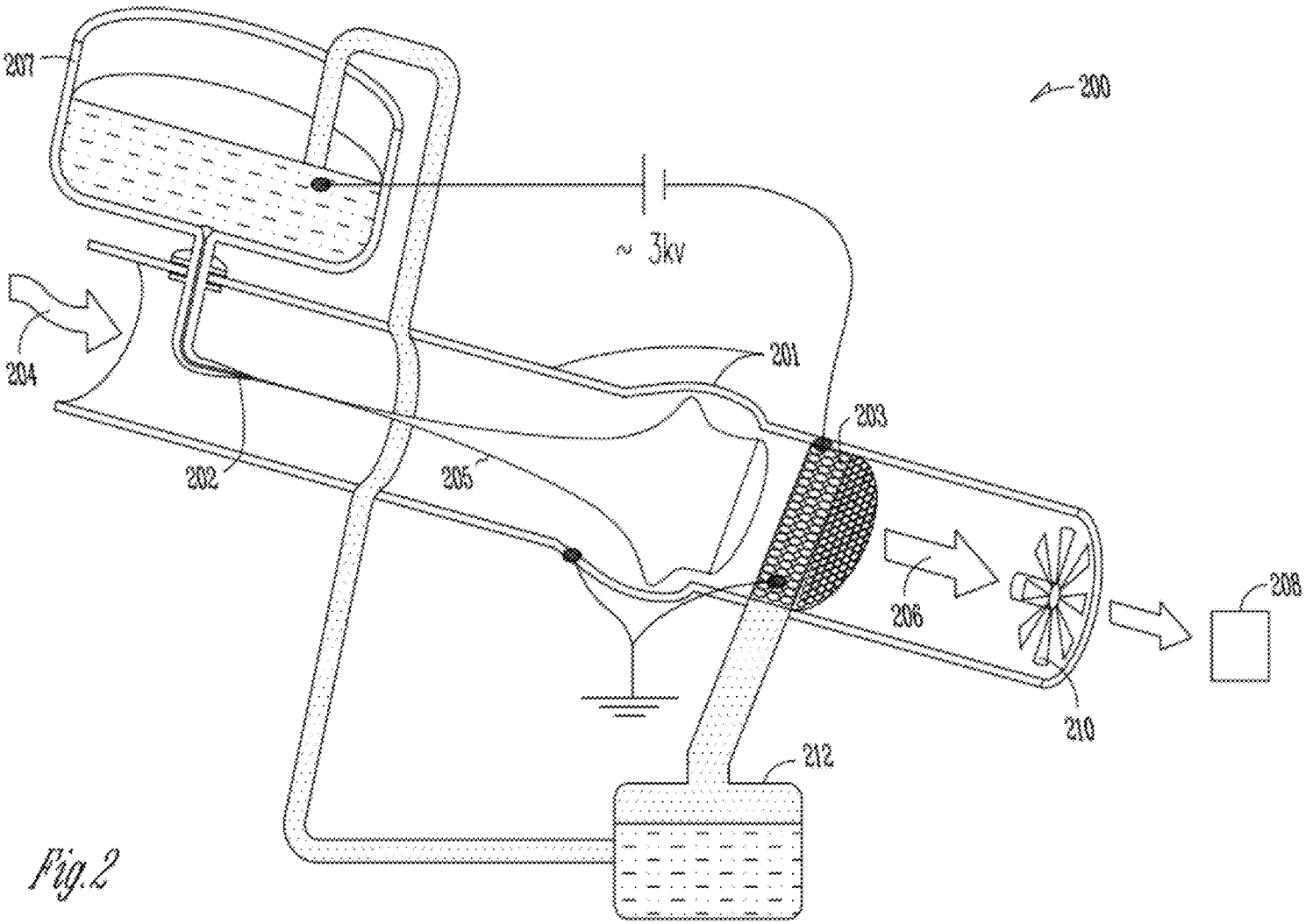
FIG. 2 is a perspective view an embodiment of the ionic liquid electrospray air scrubber prototype used for laboratory investigation.

Referring to FIG. 2, which is an embodiment of the ionic liquid electrospray air scrubber, the ionic liquid electrospray air scrubber 200 includes a 4-cm inner diameter 10-cm long metal tubing 201 and an approximately 100 μm I.D. electrospray nozzle 202 positioned co-axial at the center of the tubing 201. An approximately 3 kV potential may applied between the nozzle 202 and the grounded metal tubing/porous metal frit ensemble 201 and 203. The air stream 204, 206 may be provided in the same direction as the spray plume 205, which originates from the nozzle 202 connected to the ionic liquid reservoir 207. As the air flow 204 may be in laminar flow regime (13.5 L/min, Reynolds number approximately 230) in this embodiment, typically, it does not affect the spray cone formation and the vast majority of the ionic liquid spray is collected on the metal tubing walls 201 and 203. The porous metal frit 203 within the metal tubing/pourous frit ensemble 201/203 serves to prevent any remaining ionic liquid droplets from exiting the scrubber 200 and entering a mass spectrometer 208. Further, the electrospray plume is amenable to steering and subsequent collection via a number of mechanisms including magnetic, electrostatic, and straightforward baffling. The air scrubber canister further includes a pump 210 for causing air samples to flow through air scrubber or to augment an air flow already present in the air scrubber and a second reservoir for holding contaminated ionic fluid 212.

EXAMPLE 1

Figure 3:
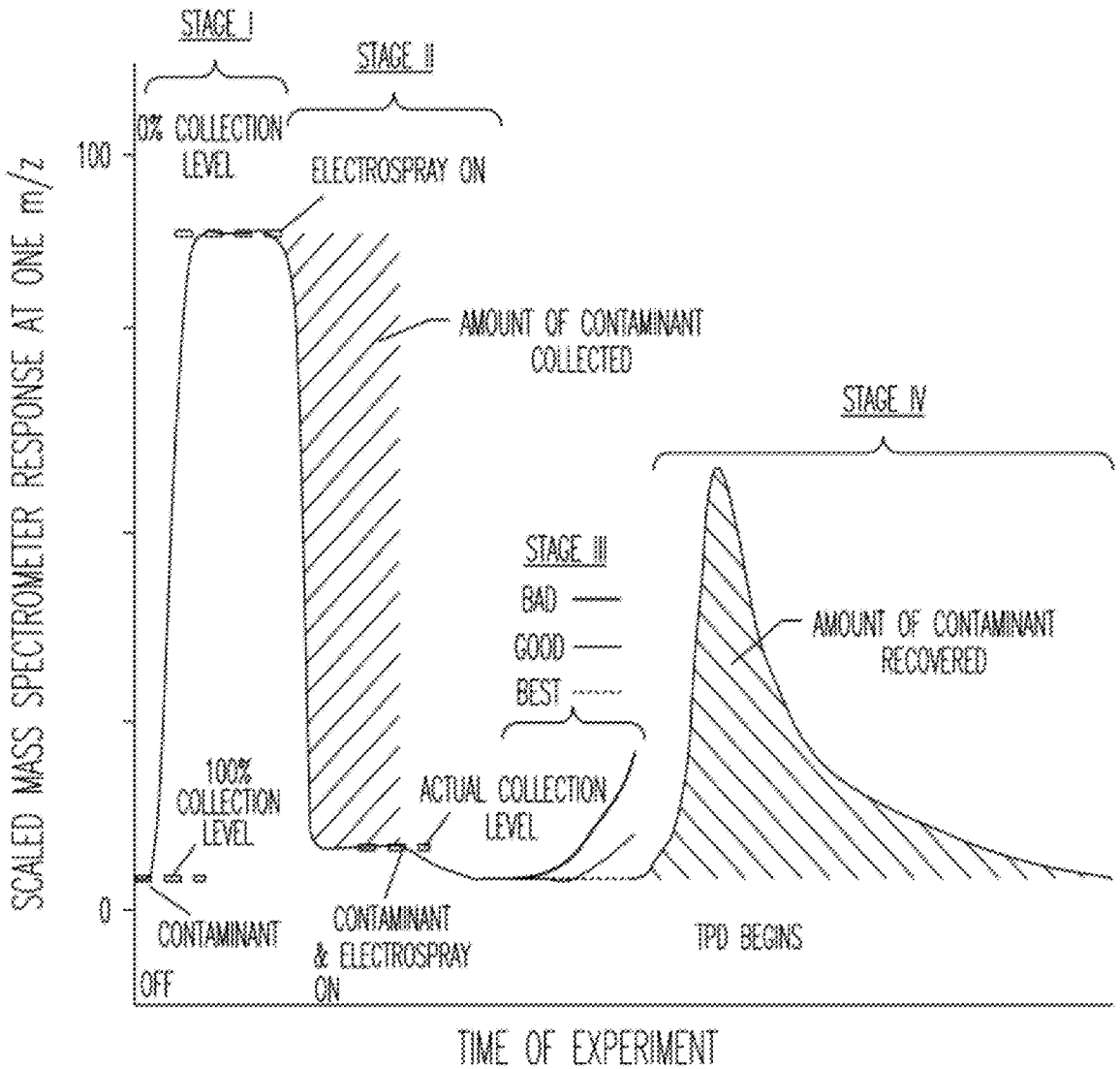
FIG. 3 is a graphical view of the hypothetical mass spectrometer signals during the testing protocol for the ionic liquid electrospray air scrubber.

The test protocol is divided into four separate stages as shown in FIG. 3. In all stages, an in-line mass spectrometer (not shown) is used to monitor the signal at one mass/charge (m/z) channel during steady state conditions. Stage I establishes the 100% and 0% capture signal heights of the mass spectrometer. Stage II evaluates the capturing efficiency for the flowing contaminants. Stage III focuses on the out-gassing characteristics of the ionic liquids with captured contaminants. Stage IV studies the thermal extraction characteristics of the ionic liquids.

In Stage I, the carrier gas alone is turned on which establishes the 100% capturing signal of mass spectrometer. After a brief period of time, the target contaminant sample is turned on, introducing into the carrier gas stream to obtain approximately 1 ppm of contaminant. The sample gas stream is pulled through the apparatus and directly into the mass spectrometer while electrospray is off. The contaminant concentration, $[\text{Contaminant}]_{ES\ off}$ is calculated from this signal, which represents 0% capturing.

Stage II of the protocol begins as the electrospray is turned on. At constant contaminant flow and ionic liquid spray rate, the apparatus will capture a constant percentage of the contaminant. This percentage may be monitored by comparing the steady state signal generated with the electrospray on, $[\text{Contaminant}]_{ES\ on}$, to the 100% and 0% signals established in stage I. The capturing efficiency is calculated as:

$$\text{Capturing Efficiency (\%)} = \frac{[\text{Contaminant}]_{ES\ off} - [\text{Contaminant}]_{ES\ on}}{[\text{Contaminant}]_{ES\ off}} \times 100\%$$

Stage III is designed to illuminate the out-gassing characteristics of the ionic liquids. To monitor this property, stage II steady state needs to be reached followed by turning off the contaminant flow and the electrospray. However, carrier gas (0-ppm analyte) will continue flowing through the testing module and into the mass spectrometer. If there is any out-gassing at room temperature from the ionic liquids, it will be seen as the line with the severe upward slope (sever out-gassing at ambient condition) or as the line with the moderate upward slope (moderately out-gassing) as shown in FIG. 3. Ideally, the ionic liquids will not out-gas and a line with zero-slope will result.

Stage IV studies the thermal extraction characteristics of the ionic liquid-captured contaminant via TPD. At this stage, the ionic liquids may be gradually heated, by heating the flow manifold, in effort to remove the collected contaminants. The result may be a tailed Gaussian curve. Comparing the area under the curve to the area of signal "collected" by the ionic liquid electrospray air scrubber typically allows a percent recovery to be calculated for each individual contaminant.

Monopole-Dipole Interaction and Charged Droplet Effective Radius

An estimate of the effective radius of a highly charged nano-droplet is derived as follows. The nano-droplet and contaminant molecule interact through monopole-dipole attraction. The force acting on the induced dipole (contaminant molecule) is:

$$F(r) = \frac{\partial \varepsilon}{\partial r} \cdot \vec{p},$$

where $\epsilon$ is the electrical field, which is $$\varepsilon(r) = \frac{CQ}{r^2},$$

where C is the Coulomb constant, Q is the number of charge on the nano-droplet, and r is the distance between the droplet and the contaminant molecule. The induced dipole moment of the contaminant molecule $\vec{p}$ is readily available for a large number of compounds. The average value is around $6.2\times 10^{-30}$ C.m.

The monopole-dipole interaction potential is:

$$U(r) = \int_{r_0}^{\infty} F(r)\,dr$$

Equating U(r) to the thermal energy, implying that contaminant molecules experience greater monopole-dipole attraction potential than their thermal potential are effectively attracted to the surface of the droplet. One may show that the effective radius of the nano-droplet is $$r_0 = \sqrt{\frac{4CQ\vec{p}}{3kT}}\,.$$

REFERENCES

1. Anthony et al., "Anion Effects on Gas Solubility in Ionic Liquids," *J. Phys. Chem. B,* 109(13), 2005, 6366-6374.
2. Anthony et al., "Solubilities and Thermodynamic Properties of Gases in the Ionic Liquid 1-n-Butyl-3-Methyl Imidazolium Hexafluorophosphate," *J. Phys. Chem. B,* 106, 2002, 7315-7320.
3. Brennecke et al., "Ionic liquids: Innovative Fluids for chemical Processing," *AIChE J.* 47, 2001, 2384-2389.
4. Crosthwaite et al., "Liquid Phase Behavior of Irnidazolium-Based Ionic Liquids with Alcohols: Effect of Hydrogen Bonding and Non-Polar Interactions," *Fluid Phase Equilibria,* 228-229C, 2005, 303-309.
5. Crosthwaite et al., "Liquid Phase Behavior of Ionic Liquids with Alcohols: Experimental Studies and Modeling," *J. Phys. Chem. B,* 110(18), 2006, 9354-9361.
6. Crosthwaite et al., "Phase Transition and Decomposition Temperatures, Heat Capacities and Viscosities of Pyridinium Ionic Liquids," *J. Chemical Thermodynamics,* 37, 2005, 559-568.
7. Fenn, U.S. Patent Application Publication No. 2004/0023411A1.
8. Richards, U.S. Pat. No. 4,095,962.
9. Tepper et al., "A New Air Sampler based on Electrically Charged Nano-droplets," *IEEE-NANO* 2006 *Sixth IEEE Conference on Nanotechnology,* 2, 2006, 781-782.
10. Aki et al., "High-pressure Phase Behavior of Carbon Dioxide with Imidazolium-based Ionic Liquds," *J. Phys. Chem. B,* 108(52), 2004, 20355-20365.
11. Anthony et al., "Anion Effects on Gas Solubility in Ionic Liquids," *J. Phys. Chem. B,* 109(13), 2005, 6366-6374.
12. Anthony et al., "Solubilities and Thermodynamic Properties of Gases in the Ionic Liquid 1-n-Butyl-3-Methyl Imidazolium Hexafluorophosphate," *J. Phys. Chem. B,* 106, 2002, 7315-7320.
13. Bates et al., *Journal of the American Chemical Society* 2002, 124, 926.
14. Blanchard et al., "Recovery of Organic Products from Ionic Liquids Using Supercritical Carbon Dioxide," *Ind. Eng. Chem. Res.,* 40(1), 2001, 287-292; Addition/Correction, 40(11), 2001, 2550.
15. Blanchard et al., "Green Processing Using Ionic Liquids and $CO_2$," *Nature,* 399, 1999, 28-29.
16. Brennecke et al., "Ionic Liquids: Innovative Fluids for Chemical Processing," *AIChE J.* 47, 2001, 2384-2389.
17. Crosthwaite et al., "Liquid Phase Behavior of Imidazolium-Based Ionic Liquids with Alcohols: Effect of Hydrogen Bonding and Non-Polar Interactions," *Fluid Phase Equilibria,* 228-229C, 2005, 303-309.
18. Crosthwaite et al., "Liquid Phase Behavior of Ionic Liquids with Alcohols: Experimental Studies and Modeling," *J. Phys. Chem. B,* 110(18), 2006, 9354-9361.
19. Crosthwaite et al., "Phase Transition and Decomposition Temperatures, Heat Capacities and Viscosities of Pyridinium Ionic Liquids," *J. Chemical Thermodynamics,* 37, 2005, 559-568.
20. Fredlake et al.,"Thermophysical Properties of Imidazolium-based Ionic Liquids," *J. Chem. Eng. Data,* 49(4), 2004, 954-964.
21. Heintz et al., *J. Chem. Eng. Data,* 2002, 47, 894-899.
22. Rodriguez et al., "Temperature and Composition Dependence of the Density and Viscosity of Binary Mixtures of Water +Ionic Liquid," *J. Chem. Eng. Data,* 51(6), 2006, 2145-2155.
23. Wasserscheid et al., "Ionic liquids—New 'Solutions' for Transition Metal Catalysis," *Angew. Chem.-Int. Edit.* 2000, 39, 3773-3789.
24. Welton, "Room-Temperature Ionic Liquids. Solvents for Synthesis and Catalysis," *Chem. Rev.,* 1999, 99, 2071-2083.

All patents and publications referenced or mentioned herein are indicative of the levels of skill of those skilled in the art to which the invention pertains, and each such referenced patent or publication is hereby incorporated by reference to the same extent as if it had been incorporated by reference in its entirety individually or set forth herein in its entirety. Applicants reserve the right to physically incorporate into this specification any and all materials and information from any such cited patents or publications.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. The methods and processes illustratively described herein suitably may be practiced in differing orders of steps, and that they are not necessarily restricted to the orders of steps indicated herein or in the claims.

What is claimed is:

1. An air scrubber comprising:

an electrospray nozzle for creating an ionic fluid electrospray plume;

an air sample intake positioned to allow an air sample to interact with the ionic fluid electrospray plume; and a counter electrode positioned to collect the electrospray plume such that selected chemicals in the air sample are captured by the ionic fluid electrospray plume and accumulate on the counter electrode;

wherein the selected chemicals are captured by one or more of electrostatic, dipole/dipole, dipole/induced dipole, London π dispersion, π stacking, and hydrogen bonding; and wherein the ionic fluid is reused to create the ionic fluid electrospray plume.

2. The air scrubber of claim 1, further comprising a first reservoir for holding ionic fluid coupled to the electrospray nozzle.

3. The air scrubber of claim 1, wherein the counter electrode comprises a porous metal frit.

4. The air scrubber of claim 1, further comprising a second reservoir for holding contaminated ionic fluid, wherein the contaminated ionic fluid comprises chemicals in the air sample that are captured by the ionic fluid.

5. The air scrubber of claim 4, wherein the second reservoir further comprises an apparatus for oxidizing, reducing, or oxidizing and reducing the contaminated ionic fluid.

6. The air scrubber of claim 5, wherein the oxidizing, reducing, or oxidizing and reducing the contaminated ionic fluid provides a reusable ionic fluid.

7. The air scrubber of claim 1, further comprising a pump for causing the air samples to flow through the air scrubber or to augment an air flow already present in the air scrubber.

8. An air scrubber system comprising:

an electrospray nozzle for creating an ionic fluid electrospray plume;

an air sample intake positioned to allow an air sample to interact with the ionic fluid electrospray plume; and a counter electrode positioned to collect the electrospray plume such that selected chemicals in the air sample are captured by the ionic fluid electrospray plume and accumulate on the counter electrode; and an electrical source for applying an alternating electrical current between the electrospray nozzle and the counter electrode;

wherein the selected chemicals are captured by one or more of electrostatic, dipole/dipole, dipole/induced dipole, London π dispersion, π stacking, and hydrogen bonding; and wherein the ionic fluid is reused to create the ionic fluid electrospray plume.

9. The air scrubbing system of claim 8 further comprising a detector positioned to analyze the air sample flowing through the counter electrode.

10. The air scrubbing system of claim 9, wherein the detector is a mass spectrometer.

11. The air scrubbing system of claim 8, wherein a wall of the air scrubber and the counter electrode are grounded.

12. The air scrubbing system of claim 8 further comprising a pump for causing the air samples to flow through the air scrubbing system or to augment an air flow already present in the air scrubbing system.

13. A method of scrubbing air for chemicals, the method comprising:

exposing an air sample to an ionic fluid electrospray plume;

applying an alternating electrical current between an electrospray nozzle and a counter electrode;

capturing the selected chemicals in the air samples onto the electrospray of the ionic fluid by one or more of electrostatic, dipole/dipole, dipole/induced dipole, London π dispersion, π stacking, and hydrogen bonding;

collecting the ionic fluid electrospray plume on an electrospray counter electrode; and reusing the ionic fluid to create the ionic fluid electrospray plume.

* * * * *